US011391012B2

(12) United States Patent
Gerber

(10) Patent No.: US 11,391,012 B2
(45) Date of Patent: Jul. 19, 2022

(54) RIPPER SHANK POCKET WITH WEAR INSERTS

(71) Applicant: Caterpillar Inc., Deerfield, IL (US)

(72) Inventor: Byron Lynn Gerber, Roanoke, IL (US)

(73) Assignee: Caterpillar Inc., Peoria, IL (US)

( * ) Notice: Subject to any disclaimer, the term of this patent is extended or adjusted under 35 U.S.C. 154(b) by 513 days.

(21) Appl. No.: 16/395,380

(22) Filed: Apr. 26, 2019

(65) Prior Publication Data

US 2020/0018039 A1 Jan. 16, 2020

Related U.S. Application Data

(60) Provisional application No. 62/698,370, filed on Jul. 16, 2018.

(51) Int. Cl.
*E02F 3/815* (2006.01)
*E02F 5/32* (2006.01)

(52) U.S. Cl.
CPC ..... *E02F 3/8152* (2013.01); *E02F 5/32* (2013.01)

(58) Field of Classification Search
CPC . E02F 3/8152; E02F 5/32; E02F 5/323; E02F 5/326
See application file for complete search history.

(56) References Cited

U.S. PATENT DOCUMENTS 2,222,071 A * 11/1940 Gustafson ..... E02F 5/32 172/762
2,882,622 A * 4/1959 Howard ..... A01G 23/06 172/199
3,141,508 A * 7/1964 Eberhart ..... A01B 13/08 172/744
3,460,634 A * 8/1969 Mathers ..... A01B 15/025 172/708
3,503,456 A * 3/1970 Larson ..... A01B 13/08 172/484
3,807,508 A * 4/1974 Kelley ..... A01B 13/08 172/484
3,870,106 A 3/1975 Gosling et al.
4,321,970 A * 3/1982 Thigpen ..... E02F 5/32 172/464
4,351,397 A * 9/1982 Winker ..... E02F 5/326 172/464
4,453,600 A 6/1984 Thigpen
4,991,659 A 2/1991 Stepe et al.
7,445,053 B2 * 11/2008 Matsumoto ..... E02F 3/7609 172/699
7,658,234 B2 2/2010 Brandt et al.
(Continued)

FOREIGN PATENT DOCUMENTS

CN 101876333 B 9/2012
CN 204849879 U 12/2015
(Continued)

OTHER PUBLICATIONS

Chinese Search Report for Appln. No. CN2019800466801, dated Feb. 18, 2022 (3 pgs).

*Primary Examiner* — Jamie L McGowan
(74) *Attorney, Agent, or Firm* — Kurt J. Fugman

(57) ABSTRACT

A wear insert includes a front surface, a rear surface, a top surface, a bottom surface, a first side surface, a second side surface, and a first retention boss extending from the rear surface.

13 Claims, 10 Drawing Sheets

(56) References Cited

U.S. PATENT DOCUMENTS

| | | | | |
|---|---|---|---|---|
| 8,490,711 | B2 * | 7/2013 | Polumati | E02F 3/7604 172/484 |
| D726,774 | S * | 4/2015 | Polumati | D15/27 |
| 2009/0050340 | A1 * | 2/2009 | McIntyre | A01B 63/10 172/182 |
| 2009/0199441 | A1 * | 8/2009 | Jorgensen | A01B 13/08 37/455 |
| 2012/0061112 | A1 | 3/2012 | Sanelli | |
| 2014/0102735 | A1 | 4/2014 | Hall | |
| 2019/0061642 | A1 * | 2/2019 | Piraino | B60T 3/00 |
| 2020/0011027 | A1 * | 1/2020 | Gerber | E02F 5/32 |
| 2020/0018038 | A1 * | 1/2020 | Gerber | E02F 3/8152 |
| 2020/0018039 | A1 * | 1/2020 | Gerber | E02F 3/8152 |

FOREIGN PATENT DOCUMENTS

| | | | |
|---|---|---|---|
| CN | 103946463 | B | 5/2016 |
| JP | 2003009601 | A | 1/2003 |

* cited by examiner

RIPPER SHANK POCKET WITH WEAR INSERTS

CROSS-REFERENCE TO RELATED APPLICATIONS

This non-provisional application claims benefit of U.S. Provisional Patent Application Ser. No. 62/698,370, filed Jul. 16, 2018, and entitled "Ripper Shank Pocket with Wear Inserts", the contents of which are hereby incorporated by reference in their entirety.

TECHNICAL FIELD

The present disclosure relates to ripper assemblies employed by earth moving, construction and mining equipment and the like to break ground or other work surfaces. Specifically, the present disclosure relates to a ripper assembly that includes a ripper shank pocket with wear inserts that are attachable and detachable from ripper shank pocket.

BACKGROUND

Earth moving, construction and mining equipment and the like are often used in rough, off-road terrain. Such equipment, including bull dozers, may use ripper assemblies with pointed ripper members that are used to break the ground or other work material so that it can be more easily manipulated, moved, etc.

Over time or in heavy ripping applications, the force exerted at the point tips by the ground or work material as the pointed tips are dragged through the ground or other work material provides a moment or torque that tends to wear on the rear of the ripper shank pocket that holds the shank of the pointed ripper members. As a result, the ripper shank pocket may become worn and elongated, allowing for greater shank movement of the pointed ripper members during normal operation. This may lead to greater stress being exerted on shank of the ripper members. Consequently, either the shank or the pocket wall may become fatigued, necessitating replacement of various components.

U.S. Pat. No. 4,453,600 to Thigpen discloses what appears to be a wear insert disposed in the shank pocket of a ripper assembly between the rear wall of the shank pocket and the shank of the ripper member (see FIG. 4). However, Thigpen fails to disclose a retention mechanism for holding the wear insert in the ripper shank pocket. Consequently, the wear insert may fall out of the ripper shank pocket, creating increased play of the shank of the ripper member in the ripper shank pocket, exacerbating the aforementioned problems.

SUMMARY

A ripper assembly according to an embodiment of the present disclosure comprises a ripper cross-member defining at least a first ripper shank pocket, the ripper cross-member including a front wall, a rear wall, a first side wall and a second side wall connecting the front wall to the rear wall, defining the perimeter of the at least first ripper shank pocket. The front wall, the rear wall, the first side wall, and the second side wall also define a longitudinal axis and a free end disposed along the longitudinal axis adjacent the perimeter of the at least first ripper shank pocket. At least one of the front wall, the rear wall, the first side wall and the second side wall define a retention boss aperture and a retention mechanism pocket.

A wear insert according to an embodiment of the present disclosure comprises a front surface, a rear surface, a top surface, a bottom surface, a first side surface, a second side surface, and a first retention boss extending from the rear surface.

A lock member according to an embodiment of the present disclosure comprises a front tool engaging portion defining an axis of rotation, and a rear portion defining a retention cavity and a first retaining ledge overhanging the retention cavity, forming an undercut along the axis of rotation, the retaining ledge extending an angle about the axis of rotation that is less than 360 degrees.

A retaining bushing according to an embodiment of the present disclosure comprises an annular body defining a cylindrical axis, an outer radial direction, a first end disposed along the cylindrical axis, a second end disposed along the cylindrical axis, an inner annular surface, an outer annular surface. A first locking ridge may extend from the outer annular surface along the outer radial direction at the first end configured to engage the retaining ledge of the lock member after the lock member has been rotated to a locking configuration. The inner annular surface may define a keyway extending along a direction parallel with the cylindrical axis. A rim portion at the second end may extend from the outer annular surface along the outer radial direction. A first male detent portion may extend from the outer annular surface along a direction parallel with the cylindrical axis.

A retention mechanism with a lock member, or a lock member and a retaining bushing according to any embodiment disclosed within the present disclosure.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

DETAILED DESCRIPTION

Figure 1:
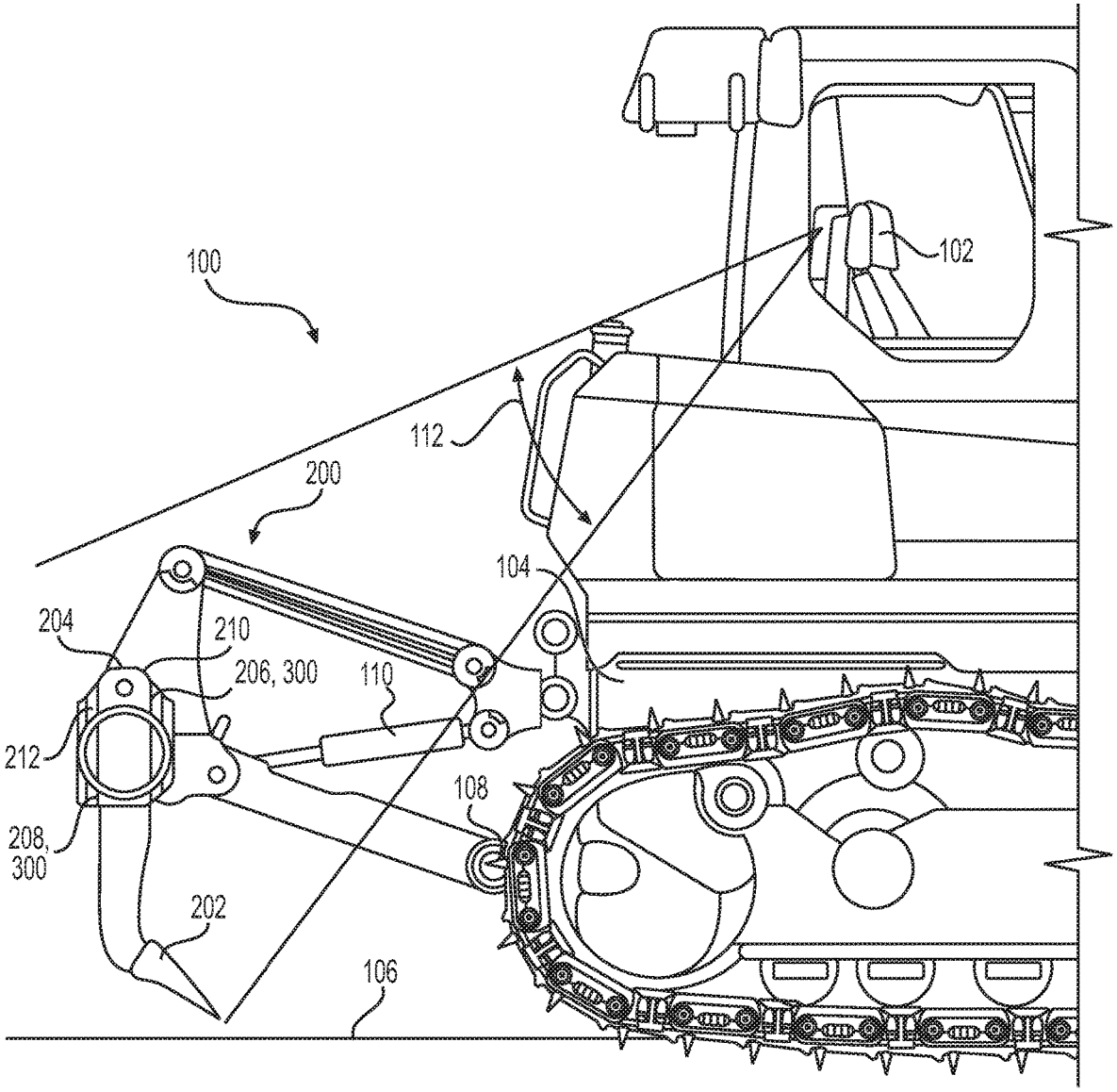
FIG. 1 is a side-view of a machine such as a bull dozer or the like that uses a ripper assembly including a ripper shank pocket with wear inserts according to various embodiments of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or by a prime for example, 100', 100" etc. It is to be understood that the use of letters or primes immediately after a reference number indicates that these features are similarly shaped and have similar function as is often the case when geometry is mirrored about a plane of symmetry. For ease of explanation in this specification, letters and primes will often not be included herein but may be shown in the drawings to indicate duplications of features, having similar or identical function or geometry, discussed within this written specification.

Various embodiments of an apparatus and a method for inserting wear inserts into a ripper shank pocket of a ripper assembly and holding the wear inserts in such a pocket will now be described. In some embodiments, the ripper shank pocket has a particular configuration. In other embodiments, the wear insert(s) designed to be inserted into the ripper shank pocket and retained therein using a retention mechanism will be discussed. Other configurations for either the ripper assembly, the ripper shank pocket, the ripper cross member, wear insert(s) etc. are possible other than what is specifically shown in the figures of the present application.

FIG. 1 shows an embodiment of a tracked machine 100 in the form of a bulldozer that includes an embodiment of a ripper assembly 200 constructed in accordance with principles of the present disclosure. Among other uses, a ripper assembly may be used to break up ground or other work material.

While the arrangement is illustrated in connection with a bulldozer, the arrangement disclosed herein has universal applicability in various other types of machines commonly used in the construction, mining or earthmoving industries. The term "machine" may refer to any machine that performs some type of operation associated with an industry such as mining, earth moving or construction, or any other industry known in the art. For example, the machine may be an excavator, wheel loader, bulldozer, grader, etc. Moreover, one or more implements may be connected to the machine. Such implements may be utilized for a variety of tasks, including, for example, manipulating a work material such as the ground, dirt, etc.

With continued reference to FIG. 1, an initial penetration view of the ripper tip 202 along a line of sight 112 from the operator cab 102 of a machine 100 using a track undercarriage 104 when the ripper assembly 200 is between a raised position and a dig position, and ripper tip 202 is at the ground penetration level 106. Thus, the operator can see the ripper shank 204 and most, if not all, of ripper tip 202 without obstruction from other parts of ripper assembly 200. This gives the operator better direct visual feedback when initiating a ripping operation. To initiate the ripping operation, the ripper assembly 200 is lowered about a pivot point 108 via hydraulic cylinder(s) 110 until the ripper tip 202 engages the ground penetration level 106. As the ripper tip 202 engages the ground, reactive forces are concentrated at the front top portion 206 and rear bottom portion 208 of the ripper shank pocket 210, disposed in an upwardly extending channel 212 connected to the ripper cross-member 214 (best seen in FIG. 2), where the ripper shank 204 pushes on the walls forming the pocket 210. Wear inserts 300 may be provided at the front top portion 206 and rear bottom portion 208 of the ripper shank pocket 210. The wear inserts may be provided at only the front top portion, at only the rear bottom portion, in the front top and front bottom portions as well as the rear bottom and rear top portions simultaneously, or any suitable combination of these positions, etc.

Figure 2:
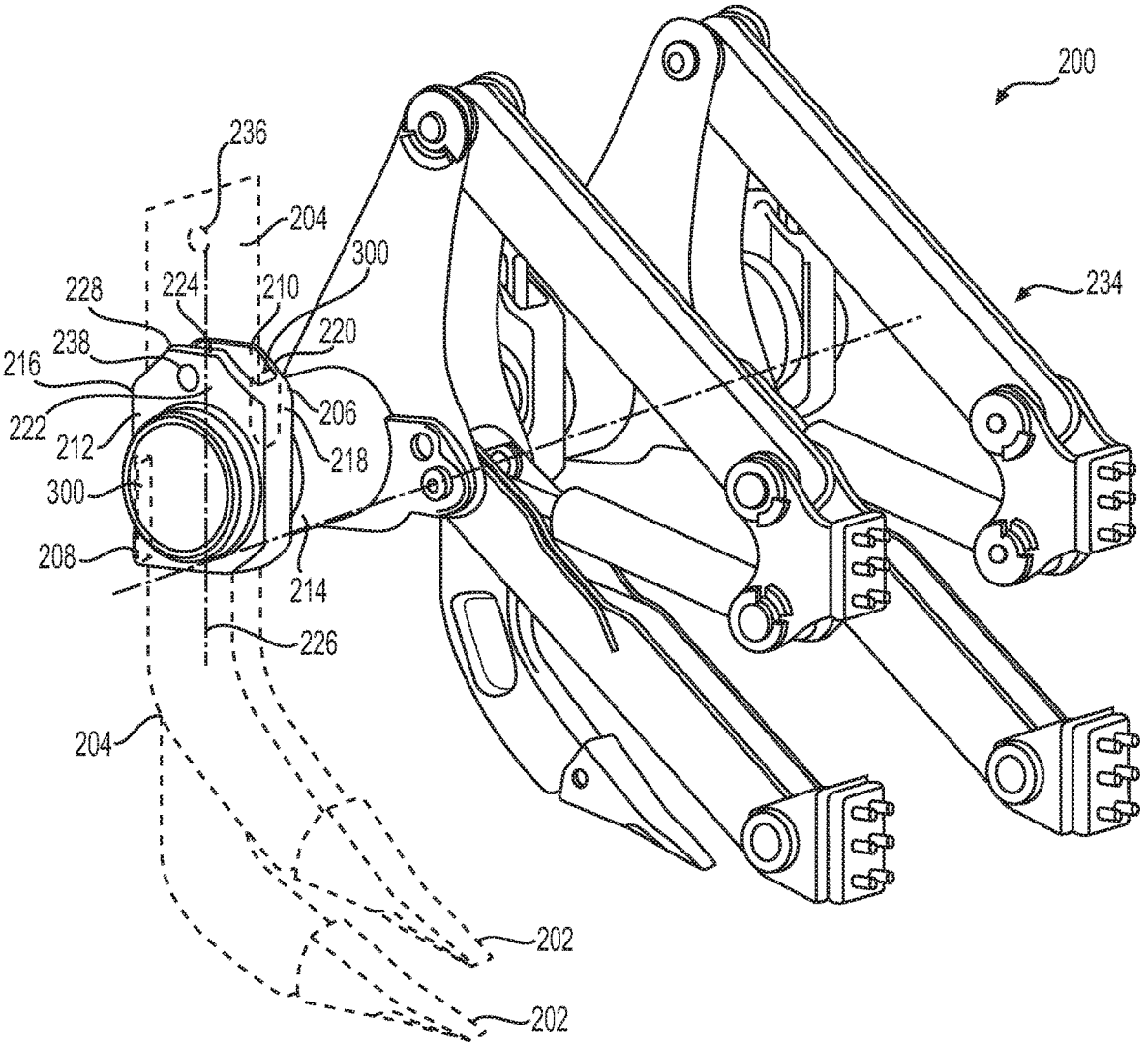
FIG. 2 is a perspective view of a portion of the ripper assembly of FIG. 1 removed from the machine, showing the ripper shank pocket with enhanced clarity.
Figure 3:
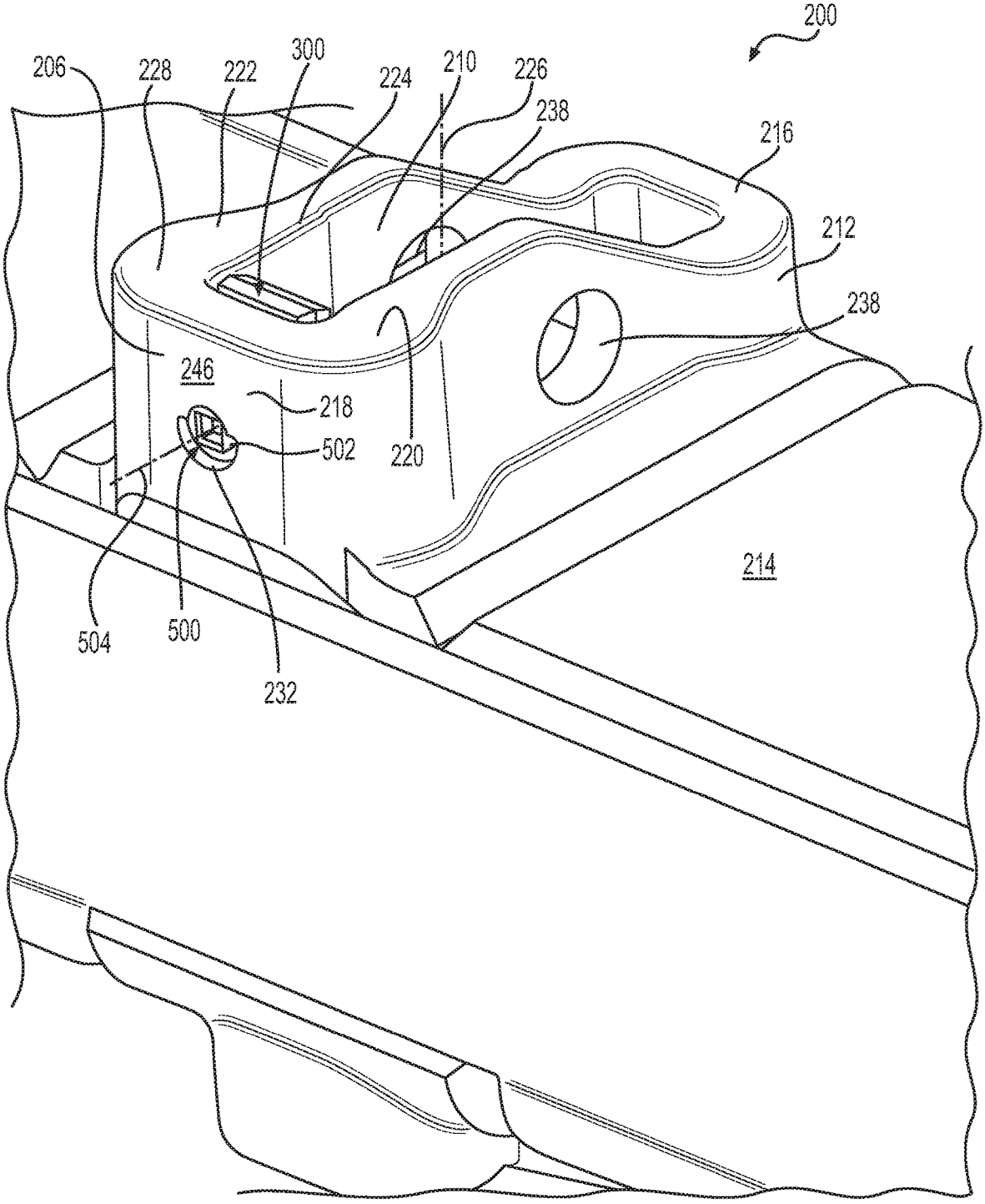
FIG. 3 is a perspective view of a ripper shank pocket of a ripper assembly similar to that shown in FIG. 2 that may have wear inserts inserted therein and held in place using a retention mechanism disposed on the rear side of the pocket according to various embodiments of the present disclosure.

Looking at FIGS. 2 and 3, it can be seen that the ripper assembly 200 according to an embodiment of the present disclosure may comprises a ripper cross-member 214 defining at least a first ripper shank pocket 210, the ripper cross-member 214 including a front wall 216, a rear wall 218, a first side wall 220 and a second side wall 222 connecting the front wall 216 to the rear wall 218, defining the perimeter 224 of the at least first ripper shank pocket 210, the front wall 216, the rear wall 218, the first side wall 220, and the second side wall 222 also defining a longitudinal axis 226 (so called at its the axis of elongation) and a free end 228 disposed along the longitudinal axis 226 adjacent the perimeter 224 of the at least first ripper shank pocket 210. At least one of the front wall 216, the rear wall 218, the first side wall 220 and the second side wall 222 defining a retention boss aperture 230 and a retention mechanism pocket 232.

It should be noted that FIG. 2 is showing the front top portion 206 of the pocket 210. It is to be understood that a similarly or identically configuration may be provided at the rear bottom portion 208 of the pocket 210. The term "top" is then a reference to the location where a wear insert 300 may be inserted, regardless of whether it is the front top portion 206 or the rear bottom portion 208, or the front bottom portion or the rear top portion, etc. Similarly, the rear wall 218 is the wall providing support to the wear insert 300 regardless of whether it is the front top portion 206 or the rear bottom portion 208, etc. The ripper assemblies 200 shown in FIGS. 2 and 3 are slightly differently configured compared to each other, showing the versatility of the various embodiments of the present disclosure as they are not limited to any particular configuration.

The ripper assembly 200 includes an articulated set of linkages 234 and hydraulic cylinders 110 for moving the ripper assembly 200 up and down, as alluded to previously. Also, the insertion of the ripper shank 204 into the channel 212 such that an attachment aperture 236 of the ripper shank 204 is aligned with the attachment aperture 238 of the channel 212, allowing a pin (not shown) or the like to hold the ripper shank 204 in place relative to the channel 212, is illustrated.

Focusing on FIGS. 3, 4 and 7 and 8, a ripper assembly 200 according to various embodiments of the present disclosure may comprise a ripper cross-member 214 defining at least a first ripper shank pocket 210. The ripper cross-member 214 may include a front wall 216, a rear wall 218, a first side wall 220 and a second side wall 222 connecting the front wall 216 to the rear wall 218, defining the perimeter 224 of the at least first ripper shank pocket 210. The front wall 216, the rear wall 218, the first side wall 220, and the second side wall 222 also defining a longitudinal axis 226 and a free end 228 disposed along the longitudinal axis 226 adjacent the perimeter 224 of the at least first ripper shank pocket 210. At least one of the front wall 216, the rear wall 218, the first side wall 220 and the second side wall 222 may define a retention boss aperture 230 and a retention mechanism pocket 232.

Figure 4:
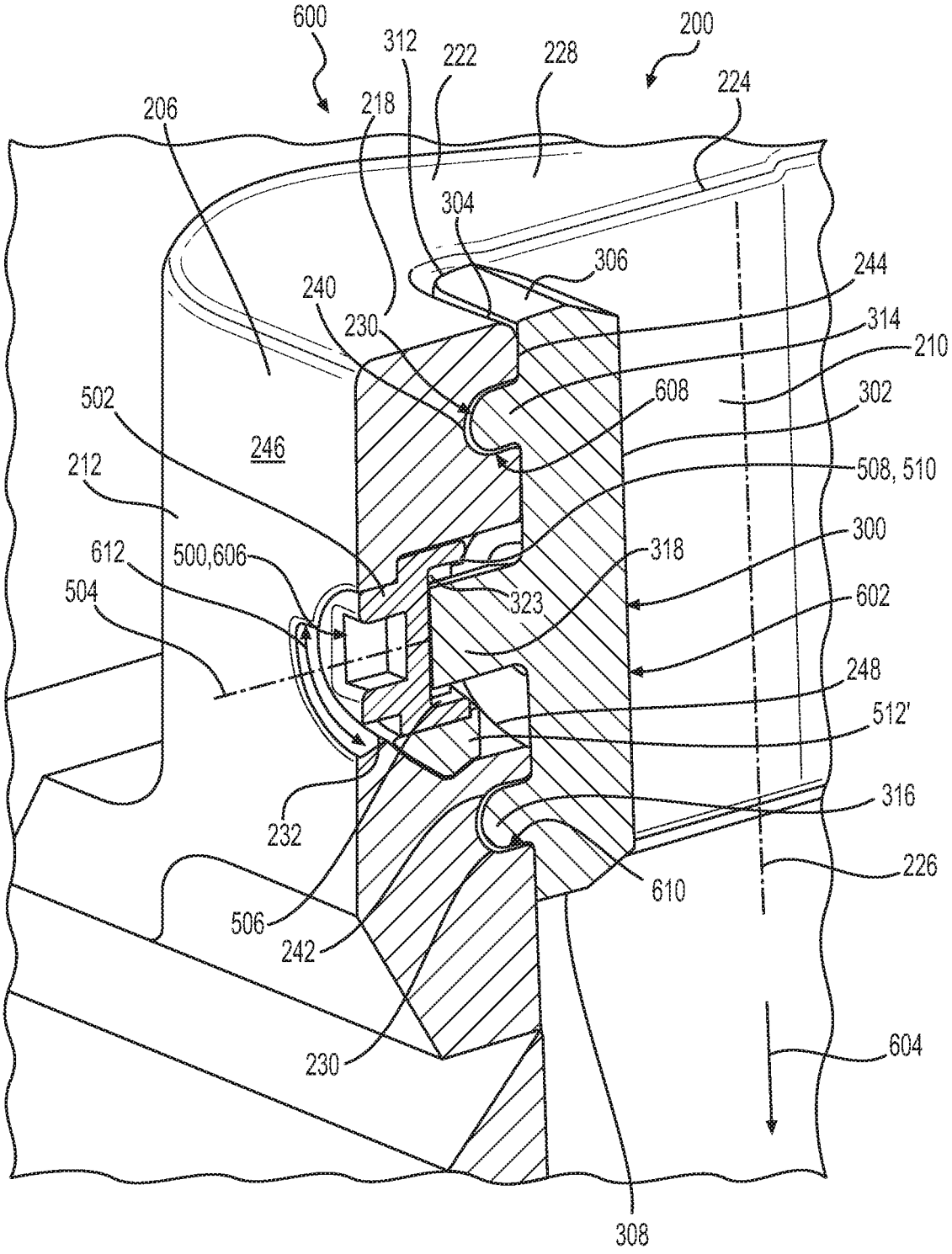
FIG. 4 is an enlarged sectional view of the ripper shank pocket of FIG. 3 shown in a slightly different orientation, illustrating a retention boss of a wear insert seated in a retention mechanism according to a first embodiment of the present disclosure.
Figure 7:
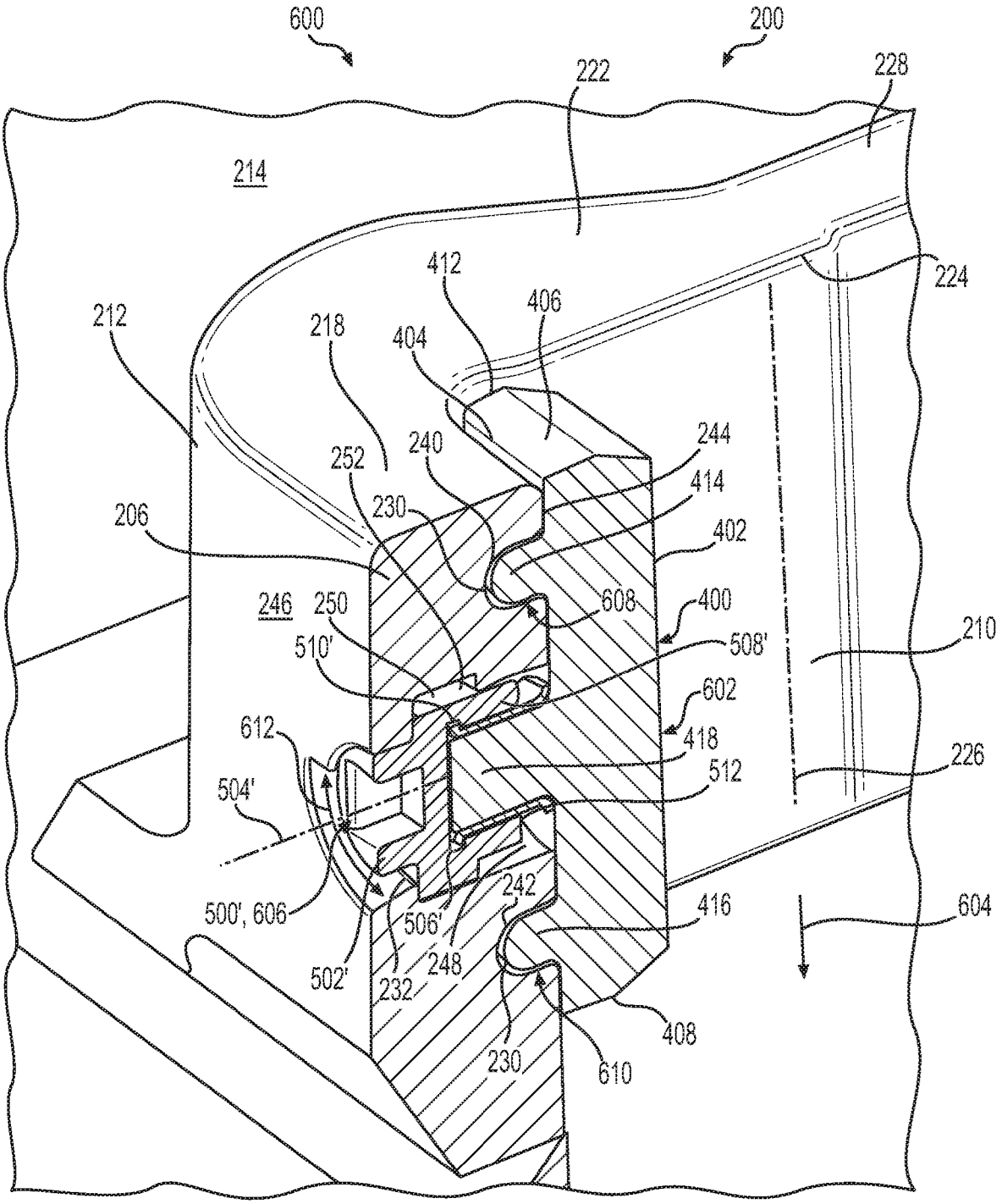
FIG. 7 is an enlarged sectional view of the ripper shank pocket of FIG. 3 shown in a slightly different orientation, illustrating a retention boss of a wear insert seated in a retention mechanism according to a second embodiment of the present disclosure.

As best seen in FIGS. 4 and 7, the retention boss aperture 230 may take the form of a first cylindrical hole 240 disposed on the rear wall 218 extending along a direction perpendicular to the longitudinal axis 226 and the retention mechanism pocket 232 may be disposed adjacent the first cylindrical hole 240 on the rear wall. For example, the first cylindrical hole 240 may be above the retention mechanism pocket 232 along the longitudinal axis 226.

The rear wall 218 may define an inner surface 244 of the at least first ripper shank pocket 210, an outer surface 246, and a second cylindrical hole 242 disposed adjacent the retention mechanism pocket 232 on the inner surface 244. The first cylindrical hole 240 may be disposed axially above the retention mechanism pocket 232 on the inner surface 244, and the second cylindrical hole 242 may be disposed axially below the retention mechanism pocket 232. The rear wall 218 also defines a clearance pocket 248 that is in communication with the retention mechanism pocket 232 that extends from inner surface 242 of the at least first ripper shank pocket 210 while the retention mechanism pocket 232 extends from the outer surface 246 of the rear wall 218.

Looking at FIGS. 3 thru 5, and 7 thru 13, the ripper assembly 200 may further comprise a retention mechanism 500 that is configured to fit within the retention mechanism pocket 232. The retention mechanism 500, 500' may include a lock member 502, 502' defining an axis of rotation 504, 504', a retention cavity 506, 506' and a retaining ledge 508, 508' overhanging the retention cavity 506, 506' forming an undercut 510, 510' along the axis of rotation 504, 504', and a retaining bushing 512. Only a lock member 502 is used in FIGS. 4 and 5 since the function of the retaining bushing is incorporated into the wear insert 300.

Figure 5:
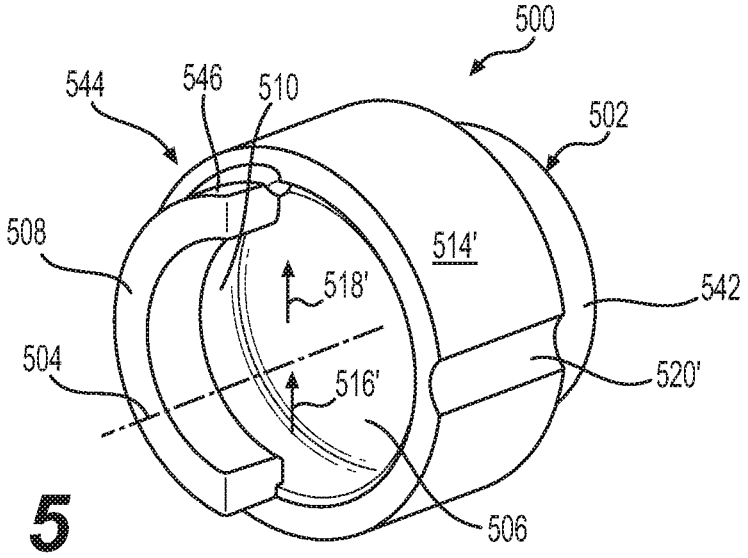
FIG. 5 is a rear oriented perspective view of the lock member of the retention mechanism of FIG. 4 shown in isolation.
Figure 8:
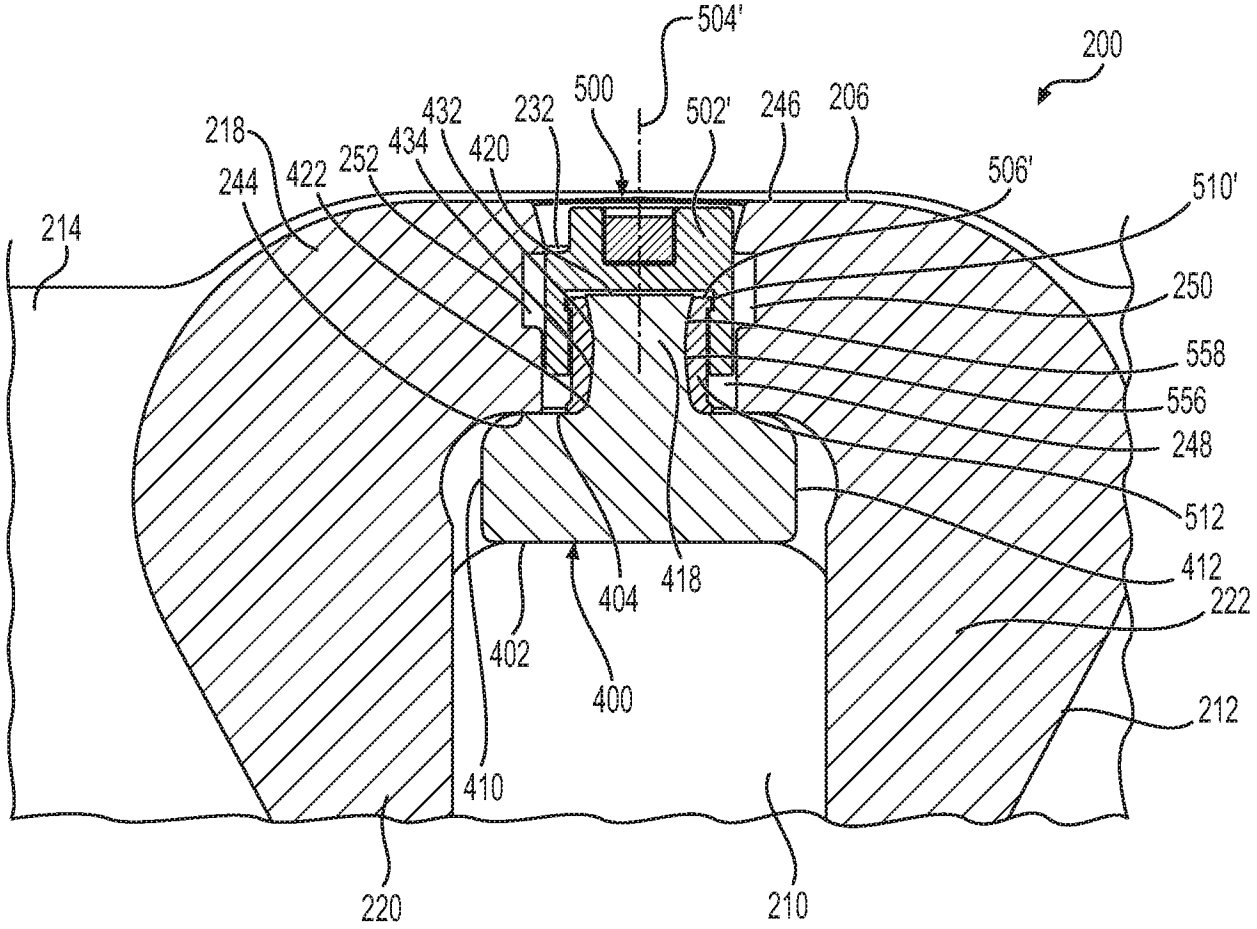
FIG. 8 is a top sectional view of the wear insert and retention mechanism of FIG. 7, depicting the snap fit of the retaining bushing onto the locking boss of the wear insert.
Figure 9:
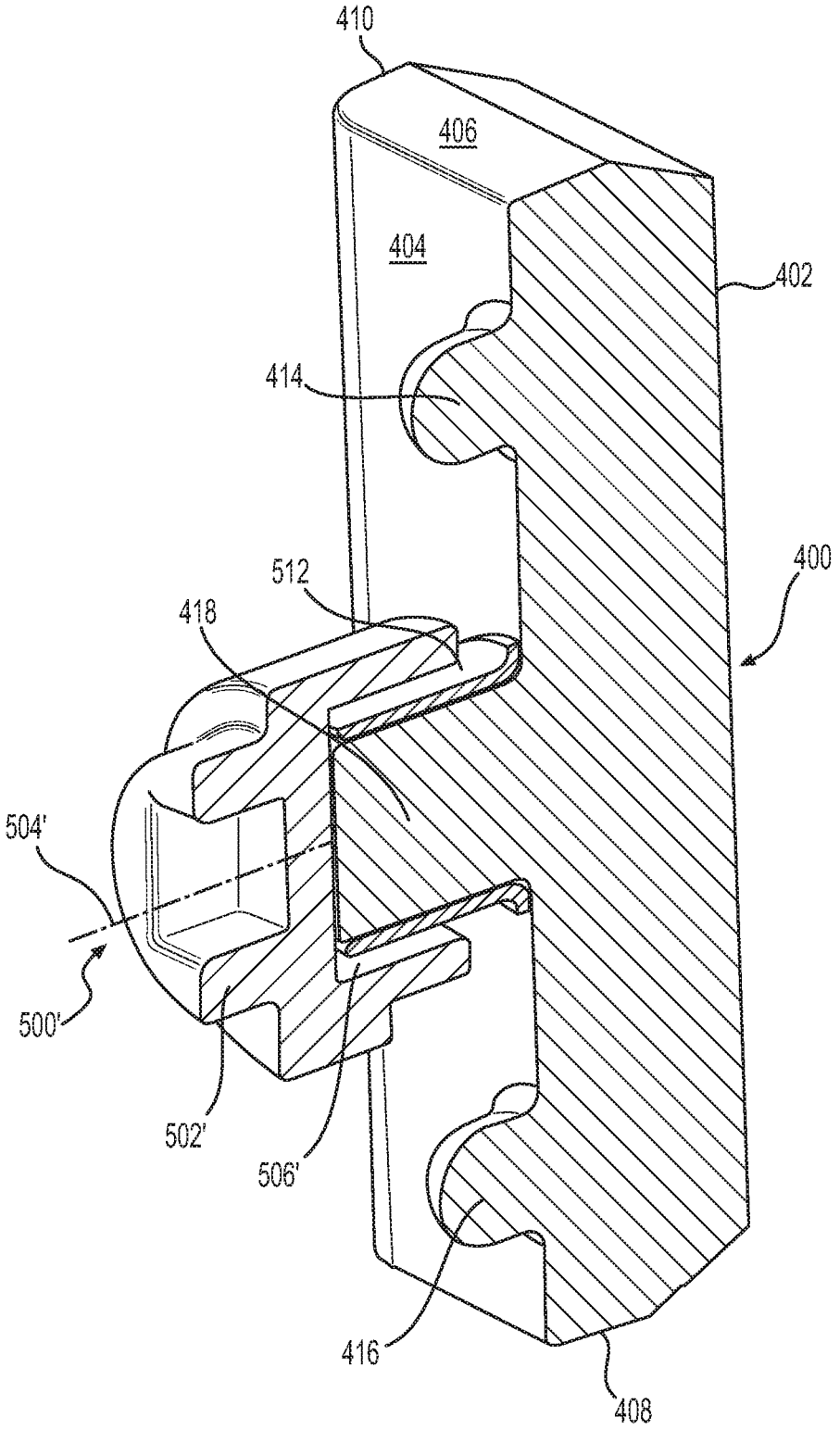
FIG. 9 is a sectional view of the retention mechanism and wear insert of FIG. 7 shown in isolation from the ripper shank pocket. These components may be provided as a kit.
Figure 11:
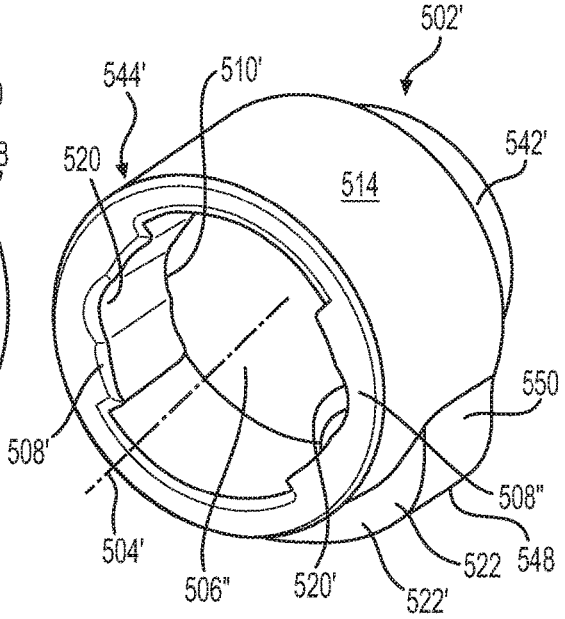
FIG. 11 is a rear oriented perspective view of the lock member of the retention mechanism of FIGS. 7, 8 and 9 shown in isolation.
Figure 12:
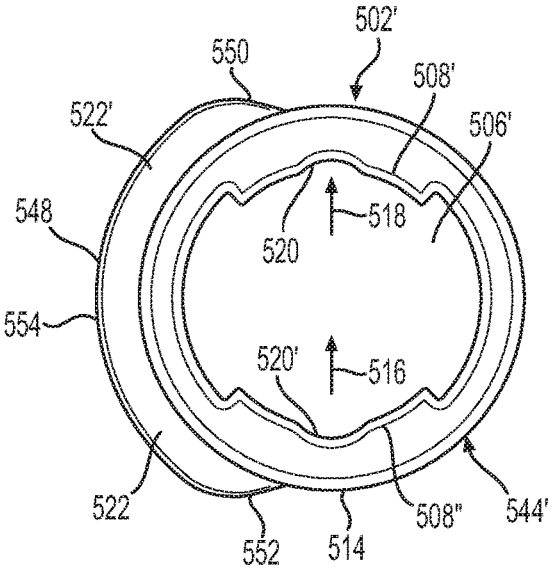
FIG. 12 is a rear view of the lock member of the retention mechanism of FIGS. 7, 8 and 9 shown in isolation.

Referring again to FIGS. 4, 5, 7 thru 13, the retention mechanism 500, 500' is disposed in retaining mechanism pocket 232 after being assembled. In FIGS. 7 thru 9, the retaining bushing 512 is disposed between the lock member 500' and the wear insert 400. In FIGS. 5, 11 and 12, the undercut 510, 510' extends an angle that is less than 360 degrees about the axis of rotation 504, 504'.

Looking at FIGS. 4, 6, 7 thru 9, and 14, various embodiments of wear inserts 300, 400 may be used that are configured to fit within the at least first ripper shank pocket 210. The wear insert 300, 400 may include a front surface 302, 402, a rear surface 304, 404, a top surface 306, 406, a bottom surface 308, 408, a first side surface 310, 410, a second side surface 312, 412, and a first retention boss 314, 414 extending from the rear surface 304, 404 along a direction perpendicular to the longitudinal axis 226.

In some embodiments, a second retention boss 316, 416 may extend from the rear surface 304, 404 along a direction perpendicular to the longitudinal axis 226, and a locking boss 318, 418 may extend from the rear surface 304, 404 along a direction perpendicular to the longitudinal axis 226. The locking boss 318, 418 may be disposed between the first retention boss 314, 414 and the second retention boss 316, 416 along the longitudinal axis 226.

Figure 6:
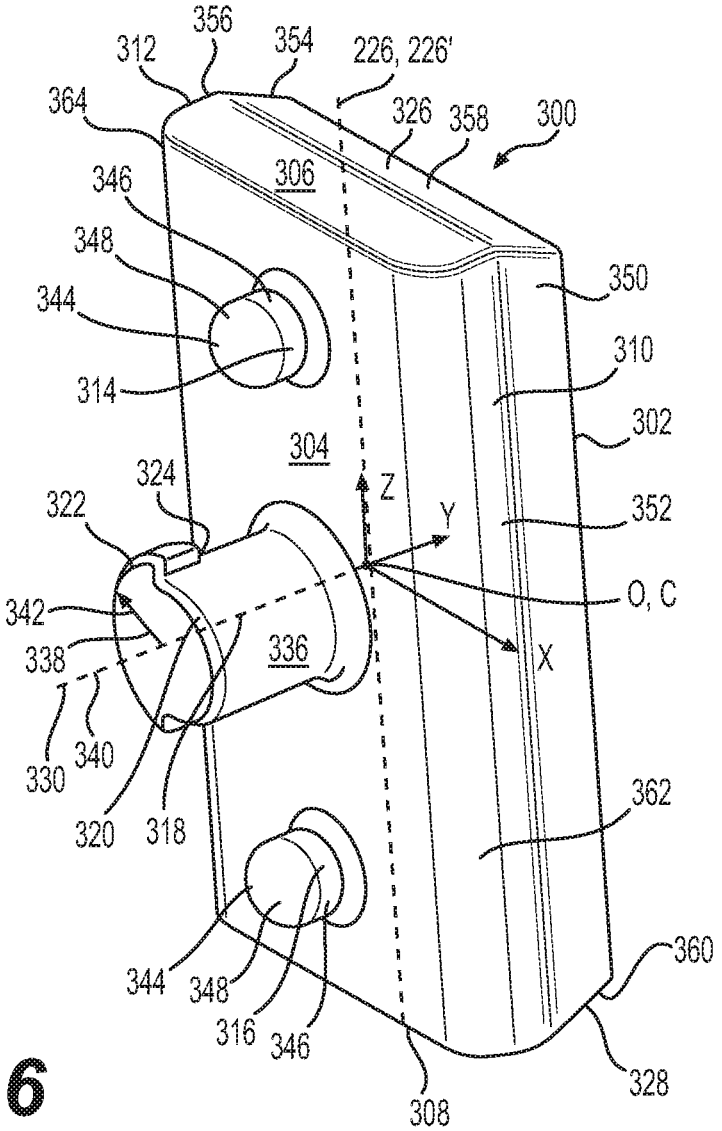
FIG. 6 is a perspective view of the wear insert shown in FIGS. 3 and 4.

In FIG. 6, the locking boss 318 may define a perimeter 320 and may include a locking ridge 322 that forms an undercut 324 along a direction that is perpendicular to the longitudinal axis 226 (see FIG. 4) that extends less than the entire length of the perimeter 320. Any of these various features and their associated configurations may be altered as needed or desired in other embodiments.

As used herein, a retention boss is so called since it prevents the removal of a wear insert along the longitudinal direction. A locking boss is so called since it prevents the removal of the wear insert along a direction that is not parallel, or perpendicular, to the longitudinal axis.

When the wear insert 300 is disposed in the at least first ripper shank pocket 210 as shown in FIG. 4, the first retention boss 314 is seated in the first cylindrical hole 240, the second retention boss 316 is seated in the second cylindrical hole 242, and the locking boss 318 is disposed in the clearance pocket 248 and the retention cavity 506 of the lock member 502. The locking ridge 322 of the locking boss 318 and the retaining ledge 508 of the lock member 502 extend an angle that is 180 degrees or less about the axis of rotation 504 of the lock member 502 (may be less than 90 degrees in some embodiments).

Figure 14:
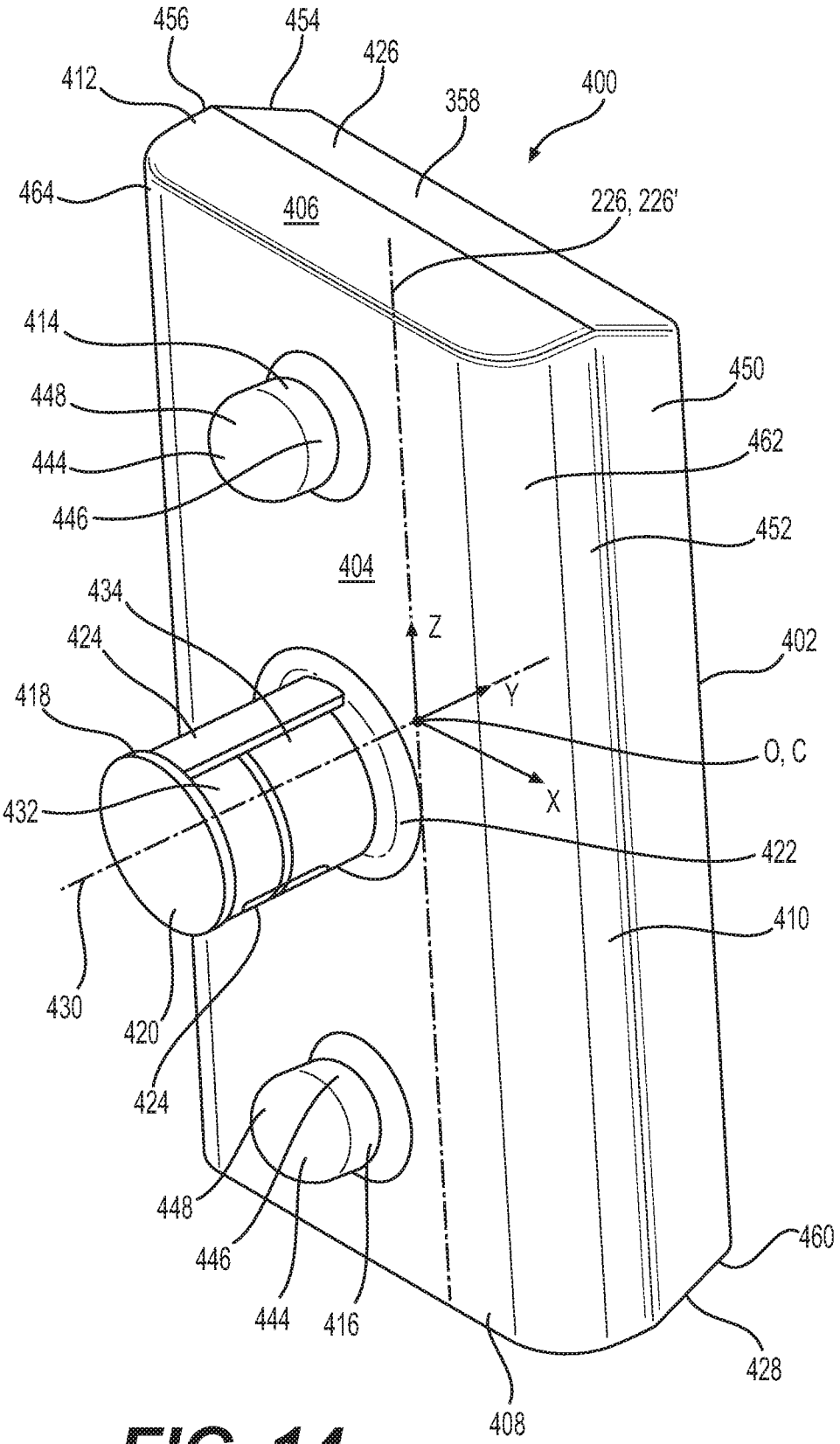
FIG. 14 is a perspective view of the wear insert shown in FIGS. 7, 8 and 9.

As best seen in FIGS. 6 and 14, the wear insert 300, 400 includes a first blend surface 326, 426 connecting the top surface 306, 406 to the front surface 302, 402, and a second blend surface 328, 428 connecting the bottom surface 308, 408 to the front surface 302, 402. The wear insert 300, 400 may be configured such that the wear insert 300, 400 defines a rotational axis 330, 430 about which the wear insert 300, 400 may be rotated so that the initial position of the first retention boss 314, 414 becomes the new position of the second retention boss 316, 416, and the initial position of the second retention boss 316, 416 becomes the new position of the first retention boss 314, 414. The first blend surface 326 and the second blend surface 426 may serve the functions of providing wear indicators. As they disappear, the user may be notified that the wear insert needs to be replaced.

Looking at the ripper shank pocket 210 in FIGS. 7 and 8, the retention boss aperture 230 may take the form of a first cylindrical hole 240 disposed on the rear wall 218 extending along a direction perpendicular to the longitudinal axis 226 and the retention mechanism pocket 232 may be disposed adjacent the first cylindrical hole 240 on the rear wall 218. The rear wall 218 also may define a notch 250 in communication with the retention mechanism pocket 232, the notch 250 defining an undercut 252 along a direction perpendicular to the longitudinal axis 226.

The rear wall 218 may define an inner surface 244 of the at least first ripper shank pocket 214, an outer surface 246, and a second cylindrical hole 242 disposed adjacent the retention mechanism pocket 232 on the inner surface 244. The first cylindrical hole may be disposed axially above the retention mechanism pocket 232 on the inner surface 244, and the second cylindrical hole 242 may be disposed axially below the retention mechanism pocket 232. The rear wall 218 also may define a clearance pocket 248 that is in communication with the retention mechanism pocket 232 that extends from inner surface 244 of the at least first ripper shank pocket 210 while the retention mechanism pocket 232 extends from the outer surface 246 of the rear wall 218.

FIGS. 7 thru 13 illustrate a retention mechanism 500' that is configured to fit within the retention mechanism pocket 232. Looking at FIGS. 11 thru 13, the retention mechanism 500' may include a lock member 502' defining an axis of rotation 502', an outer cylindrical surface 514, an inner radial direction 516, an outer radial direction 518, a retention cavity 506' and including a retaining ledge 508' overhanging the retention cavity 506' along the inner radial direction 516, forming an undercut 510' along the axis of rotation 504'. The lock member 502' further defining a female detent portion 520 on the retaining ledge 508' extending along a direction parallel with the axis of rotation 502'. The lock member 502' may also include a lock tab 522 extending in the outer radial direction 518 from the outer cylindrical surface 514.

Figure 10:
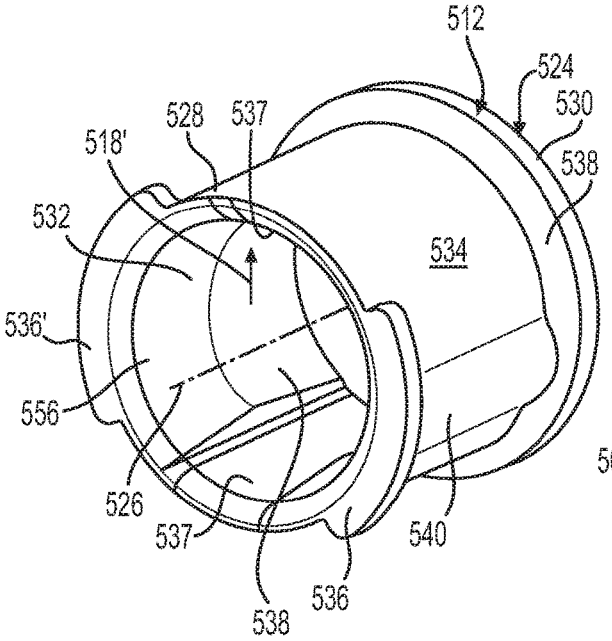
FIG. 10 is a perspective view of a retaining bushing according to another embodiment, utilized in the retention mechanism of FIGS. 7, 8 and 9.

Looking at FIG. 10, the retention mechanism 500' may further comprise a retaining bushing 512 including an annular body 524 defining a cylindrical axis 526, an outer radial direction 518', a first end 528 disposed along the cylindrical axis 518', a second end 530 disposed along the cylindrical axis 526, an inner annular surface 532, an outer annular surface 534, and including a locking ridge 536 extending from the outer annular surface 534 along the outer radial direction 518' at the first end 528 configured to engage the retaining ledge 508 of the lock member 502 after the lock member 502 has been rotated to a locking configuration. The inner annular surface 532 may define a keyway 537 extending along a direction parallel with the cylindrical axis 526. A rim portion 538 may be provided at the second end 530 and may extend from the outer annular surface 534 along the outer radial direction 518'. A male detent portion 540 may extend from the outer annular surface 534 along a direction parallel with the cylindrical axis 526.

As best seen in FIGS. 7 thru 9, the retention mechanism 500' is disposed in retaining mechanism pocket 232, the retaining bushing 512 is disposed between the lock member 502' and the wear insert 400, and the undercut 510' extends an angle that is less than 360 degrees about the axis of rotation 504' (see FIG. 10).

Referring to FIGS. 8 and 14, the wear insert 400 that is configured to fit within the at least first ripper shank pocket 210 may be described as follows. The wear insert 400 may include a front surface 402, a rear surface 404, a top surface 406, a bottom surface 408, a first side surface 410, a second side surface 412, a first retention boss 414 extending from the rear surface 404 along a direction perpendicular to the longitudinal axis 226, a second retention boss 416 extending from the rear surface 404 along a direction perpendicular to the longitudinal axis 226, and a locking boss 418 extending from the rear surface 404 along a direction perpendicular to the longitudinal axis 226 and that is disposed between the first retention boss 414 and the second retention boss 416 along the longitudinal axis 226. The locking boss 418 may include a free end 420 and an attachment portion 422 extending from the rear surface 404, a key portion 424 configured to be inserted into the keyway 537 of the retaining bushing 512, an inwardly flaring portion 432 extending from the free end 420, and an outwardly flaring portion 434 extending from the inwardly flaring portion 432 to the attachment portion 422.

The diameter of the inwardly flaring portion 432 decreases from the free end 420 to the outwardly flaring portion 434 and the diameter of the outwardly flaring portion 434 increases from the inwardly flaring portion 432 to the attachment portion 422 along a direction perpendicular to the longitudinal axis 226.

Referring now to FIGS. 7 thru 9, the wear insert 400 may be disposed in the at least first ripper shank pocket 210 and the first retention boss 414 may be seated in the first cylindrical hole 240. At about the same time, the second retention boss 416 may be seated in the second cylindrical hole 242 and the locking boss may be disposed in the clearance pocket 248 and the retention cavity 506' of the lock member 502'. Previously, the retaining bushing 512 may have already been installed onto the locking boss 418. The locking ridge 536 of the retaining bushing 512 and the retaining ledge 508' of the lock member 502' may extend an angle that is 90 degrees or less about the axis of rotation 504' of the lock member 502'.

Various embodiments of a wear insert that may be provided as a replacement part will now be described with reference to FIGS. 6 and 14. The wear insert 300, 400 may comprise a front surface 302, 402, a rear surface 304, 404, a top surface 306, 406, a bottom surface 308, 408, a first side surface 310, 410, a second side surface 312, 412, a first retention boss 314, 414, and a second retention boss 316, 416. A first blend surface 326, 426 may be provided that connects the top surface 306, 406 to the front surface 302, 402. In some embodiments, a second blend surface 328, 428 may also be provided that connects the bottom surface 308, 408 to the front surface 302, 402. As used herein, "blend" may mean any form of transitional geometry including chamfers, radii, etc.

The wear insert 300, 400 may be configured such that the wear insert 300, 400 defines a rotational axis 330, 430 about which the wear insert 300, 400 may be rotated so that the initial position of the first retention boss 314, 414 becomes the new position of the second retention boss 316, 416, and the initial position of the second retention boss 316, 416 becomes the new position of the first retention boss 314, 414. In some embodiments, a Cartesian coordinate system X, Y, Z with an origin O placed at the center of mass C (centroid) of the wear insert 300, 400, may define one, two, or three axes of rotation (e.g. X axis, Y axis, Z axis) that allow the wear insert 300, 400 to be used in multiple orientations. Similarly, one, two or three planes of symmetry for the wear insert 300, 400 may be provided (e.g. X-Y plane, Y-Z plane, X-Z plane) so that these features are also mirrored or symmetrical about these various planes. Other embodiments may lack any symmetry or rotational axes, etc.

As alluded to earlier herein, the first retention boss 314, 414 and the second retention boss 316, 416 may extend from the rear surface 304, 404 and the wear insert 300, 400 may further comprise a locking boss 318, 418 extending from the rear surface 304, 404. The wear insert 300, 400 may also define a longitudinal axis 226', and a direction perpendicular to the longitudinal axis 226' and the rear surface 304, 404. The locking boss 318, 418 may be longer than the first retention boss 314, 414 and the second retention boss 316, 416 along the direction perpendicular to the longitudinal axis 226' (e.g. Y axis). As shown in FIGS. 6 and 14, the first retention boss 314, 414 is identically configured as the second retention boss 316, 416, and the locking boss is disposed between the first retention boss 314, 414 and the second retention boss 316, 416 along the longitudinal axis 226'. This may not the case for other embodiments.

As seen in FIG. 6, the locking boss 318, 418 may include a cylindrical surface 336 defining a radial direction 338 and a cylindrical axis 340, a free end 342 and a locking ridge 322 extending radially from the cylindrical surface 336 defining an angle about the cylindrical axis 340 that is 180 degrees or less.

As shown in FIGS. 6 and 14, the first retention boss 314, 414 and the second retention boss 316, 416 each include a free end 344, 444, a cylindrical portion 346, 446 connecting to rear surface 304, 404 and a spherical radial portion 348, 448 at the free end 344, 444. In FIG. 14, the locking boss 418 may include a free end 444 and may further comprise a key 42 extending from the free end 444 toward the rear surface 404, an inwardly flaring portion 432 extending from the free end 444 toward the rear surface 404, and an outwardly flaring portion 434 extending from the inwardly flaring portion 432 toward the rear surface 404.

With continued reference to FIGS. 6 and 14, the first side surface 310, 410 includes a first angled surface 350, 450 (e.g. not substantially parallel to the Y-Z plane) disposed adjacent the front surface 302, 402 and a first straight surface 352, 452 (e.g. substantially parallel to the Y-Z plane) disposed adjacent the rear surface 304, 404. Likewise, the second side surface 312, 412 includes a second angled surface 354, 454 disposed adjacent the front surface 302, 402 and a second straight surface 356, 456 disposed adjacent the rear surface 304. For these embodiments, the first side surface 310, 410 and the second side surface 312, 412 and their associated features may be symmetrical about the Y-Z plane. This may not be the case in other embodiments.

Still referring to FIGS. 6 and 14, the first blend surface 326, 426 may be a first chamfered surface 358, 458 and the second blend surface 328, 428 may be a second chamfered surface 360, 460. The first blend surface 326, 426 and the second blend surface 328, 428 may be symmetrical about the X-Y plane. Also, the wear insert 300, 400 may further comprise a third blend surface 362, 462 (e.g. a radius) joining the first straight surface 352, 452 to the rear surface 304, 404 and a fourth blend surface 364, 464 joining the second straight surface 356, 456 to the rear surface 304, 404. The third blend surface 362, 462 and fourth blend surface 364, 464 may be symmetrical about the Y-Z plane. Any of the features discussed herein may not be symmetrical to each other about any plane in other embodiments.

The wear inserts 300, 400 may have a height along the Z axis (maximum dimension) that is greater than the width along the X axis (maximum dimension). The width may be greater than the thickness along the Y axis (maximum dimension). In particular, the wear inserts 300, 400 may have a substantially cubic or rectangular configuration.

Focusing on FIGS. 5, and 11 thru 13, a lock member 502, 502' may also be provided that comprises a front tool engaging portion 542, 542' defining an axis of rotation 504, 504', and a rear portion 544, 544' defining a retention cavity 506, 506' and a first retaining ledge 508, 508' overhanging the retention cavity 506, 506', forming an undercut 510, 510' along the axis of rotation 504, 504'. The retaining ledge 508, 508' may extend an angle about the axis of rotation 504, 504' that is less than 360 degrees. The angle may be 180 degrees or less.

In FIG. 4, the rear portion 544 may include an outer cylindrical surface 514' defining a radial direction 518', 516', and a first female detent portion 520' that extends along the axis of rotation 504 and is in phase angularly about the axis of rotation 504 with the first retaining ledge 508. The first retaining ledge 508 may include an offset outer cylindrical surface 546 that is spaced radially from the outer cylindrical surface 514' of the rear portion 544. The outer cylindrical surface 514' may define a second female detent portion (not shown-hidden) disposed diametrically opposite of the first female detent portion 520'.

Looking at FIGS. 7 thru 9, the rear portion 544' may further comprise a second retaining ledge 508' overhanging the retention cavity 506', forming an undercut 510' along the axis of rotation 504'. The first retaining ledge 508' and the second retaining ledge 508" may each extend an angle about the axis of rotation 504 that is 90 degrees or less. More particularly, the first and the second retaining ledges 508', 508" may be identically configured. The first female detent portion 520, the second female detent portion 520', the first retaining ledge 508' and the second retaining ledge 508" are all angularly in phase with each other about the axis of rotation 504'. The lock member 502' may further comprise a locking rib 522' that extends from the outer cylindrical surface 514 of the rear portion. The locking rib 522' may include an arcuate surface 548 having a first angular extent 550, a second angular extent 552, and a peak 554 therebetween. The arcuate surface 548 connects to the outer cylindrical surface 514 at the first angular extent 550 and at the second angular extent 552. This locking rib 522' is configured to fit in the notch 250 of the rear wall 218, preventing removal of the wear insert 400.

Various embodiments of a retaining bushing 512 that may be provided as a replacement part will now be described with reference to FIG. 10. The retaining bushing 512 may comprise an annular body 524 defining a cylindrical axis 526, an outer radial direction 518', a first end 528 disposed along the cylindrical axis 526, a second end 530 disposed along the cylindrical axis 526, an inner annular surface 532, and an outer annular surface 534. The retaining bushing 512 may include a first locking ridge 536 extending from the outer annular surface 534 along the outer radial direction 518' at the first end 528 configured to engage the retaining ledge 508' of the lock member 502' after the lock member 502' has been rotated to a locking configuration (e.g. 180 degrees). The inner annular surface 532 may define a keyway 537 extending along a direction parallel with the cylindrical axis 526. A rim portion 530 may be provided at the second end 430 extending from the outer annular surface 534 along the outer radial direction 518'. Various features may be omitted or be differently configured than what has been discussed herein.

A first male detent portion 540 may extending from the outer annular surface 534 along a direction parallel with the cylindrical axis 526. The first male detent portion 540 may be angularly in phase with the first locking ridge 536 about the cylindrical axis. Likewise, a second retaining ridge 536' may be provided that is diametrically opposite the first retaining ridge 536.

As shown, the first and the second retaining ridges 536, 536' may be identically configured, extending an angle about the cylindrical axis 526 that is 90 degrees or less. The inner annular surface 532 may be divided into a lead-in surface 556 (so called as it eases installation of the retaining bushing 512 onto the locking boss 418 of the wear insert 400, see FIG. 8) and a catch surface 558 (so called as it helps prevent the removal of the retaining bushing 512 from locking boss 418 of the wear insert 400, see FIG. 8) and the rim 530 extends about the cylindrical axis 526 an angle of 360 degrees. Any of these features may be omitted or changed in configuration as needed or desired in other embodiments.

FIG. 4 shows another retaining bushing 512' that may be used with certain embodiments. This retaining bushing 512' is sold under the TRADENAME of CAPSURE by the assignee of the present disclosure.

For many embodiments, the wear insert and/or the lock member may be cast using iron, grey-iron, steel or other suitable materials. Other manufacturing processes may be used to make the wear inserts and/or the lock member such as any type of machining, forging, etc. For example, steel or "tough steel" may be used to create the wear insert and/or the lock member. Wear inserts and/or lock members may also be coated, heat treated, etc. to provide suitable characteristics for various applications. The wear insert or any other component discussed herein may be made for a unitary component or may be split into multiple components to form a subassembly, etc. The retaining bushing may be injection molded using a polyurethane material. Other suitable materials such as thermoplastic, thermoset materials, etc. may be used to form the bushing.

Any of the features discussed herein may omit the small blends shown in the drawings but not specifically mentioned in the written specification and these features may be ignored. Similarly, small draft angles (e.g. less than 5 degrees) may be ignored and/or omitted in various embodiments. Any suitable retention mechanism may be employed to retain the wear insert in the shank ripper pocket. Also, any of the dimensions, configurations, etc. discussed herein may be varied as needed or desired to be different than any value or characteristic specifically mentioned herein.

INDUSTRIAL APPLICABILITY

In practice, a ripper assembly, a wear insert, a ripper cross-member, a retention mechanism, a lock member, a retaining bushing and/or a channel according to any embodiment described herein may be sold, bought, manufactured or otherwise obtained in an OEM or after-market context. In some cases, the wear insert and retention mechanism may be provided as a kit, etc.

Referring now to FIGS. 4 and 7, a method 600 of assembling a ripper assembly 200 may be understood. A wear insert 300, 400 may be provided to which a retention boss 314, 414 is attached or integrally formed therewith (step 602). Then, the wear insert 300, 400 may be inserted downward along the longitudinal axis 226 of a shank ripper pocket 210 until the retention boss 314, 414 is aligned with a retention boss aperture 230 in the rear wall 216 (step 604). In many cases, the retention mechanism 500, 500' may have already been inserted into the retention mechanism pocket 232 and held therein (step 606) in an unlocked configuration. That is to say, the retaining ledge 508, 508', 508" will not interfere with the locking ridge 322, 536. Then, the wear insert 300, 400 is moved until the retention boss 314, 414 is in the retention boss aperture 230 (step 608).

At about the same time, if a second retention boss 316, 416 is provided, then the second retention boss 316, 416 enters into another retention boss aperture (step 610) and the locking ridge 322, 536 moves past the retaining ledge 508, 508', 508". Then, the lock member 502, 502' is rotated 180 degrees until the lock member 502 is in a locked configuration (step 612). That is to say, the retaining ledge, 508, 508', 508" rotates past the locking ridge 322, 536, preventing movement of the wear insert 300, 400 in a direction not parallel to the longitudinal axis 226.

Figure 13:
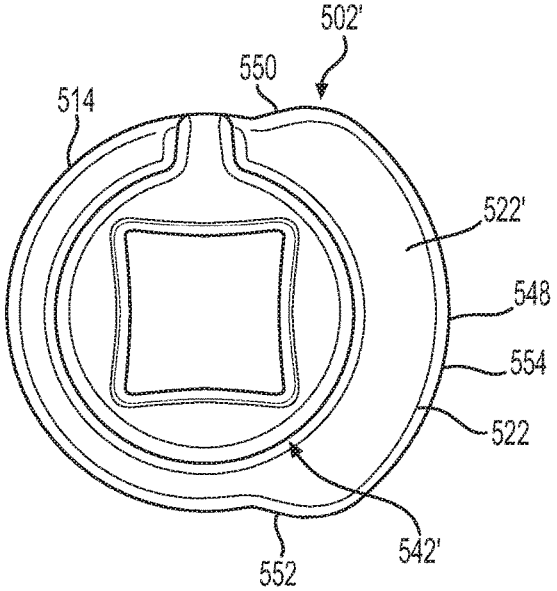
FIG. 13 is a front view of the lock member of the retention mechanism of FIGS. 7, 8 and 9 shown in isolation.

Rotation of the lock member may be achieved by inserting a square shaped drive head of a wrench (not shown) or similar tool into a complimentarily shaped pocket of the front tool engaging portion 542 (see FIGS. 3 and 13). Then, the lock member is rotated to achieve the locked configuration. In either extreme position (locked or unlocked configuration), detents 540 on the retaining bushing 512, 512' hold the lock member 502, 502' in position unless sufficient torque is provided to move the lock member to overcome the detent force. This helps to ensure that the wear insert will not fall out of the ripper shank pocket due to vibration, gravity, etc. The locking and unlocking of the retention mechanism is repeated if there are two such retaining mechanisms used to hold the wear insert in place.

While wear inserts that are used to absorb the load exerted on a ripper member has been specifically discussed, it is to be understood that other applications are also considered to be within the scope of the present application. Any of the components or features disclosed herein may be altered compared to what has been specifically described in this specification or shown in the figures as needed or desired.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, it is intended that the specification and examples be considered as exemplary only, with a true scope and spirit of the invention(s) being indicated by the following claims and their equivalents.

What is claimed is:

1. A ripper assembly comprising:

a ripper cross-member defining at least a first ripper shank pocket, the ripper cross-member including a front wall, a rear wall, a first side wall and a second side wall connecting the front wall to the rear wall, defining the perimeter of the at least first ripper shank pocket, the front wall, the rear wall, the first side wall, and the second side wall also defining a longitudinal axis and a free end disposed along the longitudinal axis adjacent the perimeter of the at least first ripper shank pocket; and at least one of the front wall, the rear wall, the first side wall and the second side wall defining a retention boss aperture and a retention mechanism pocket, wherein the retention boss aperture includes a first cylindrical hole disposed on the rear wall extending along a direction perpendicular to the longitudinal axis and the retention mechanism pocket is disposed adjacent the first cylindrical hole on the rear wall.

2. The ripper assembly of claim 1, wherein the rear wall defines an inner surface of the at least first ripper shank pocket, an outer surface, a second cylindrical hole disposed adjacent the retention mechanism pocket on the inner surface and the first cylindrical hole is disposed axially above the retention mechanism pocket on the inner surface, and the second cylindrical hole is disposed axially below the retention mechanism pocket, and the rear wall also defines a clearance pocket that is in communication with the retention mechanism pocket that extends from inner surface of the at least first ripper shank pocket while the retention mechanism pocket extends from the outer surface of the rear wall.

3. The ripper assembly of claim 2 further comprising a retention mechanism that is configured to fit within the retention mechanism pocket, the retention mechanism including a lock member defining an axis of rotation, a retention cavity and a retaining ledge overhanging the retention cavity, forming an undercut along the axis of rotation, and a retaining bushing.

4. The ripper assembly of claim 3 further comprising a wear insert disposed in the at least first ripper shank pocket and wherein the retention mechanism is disposed in retaining mechanism pocket, the retaining bushing is disposed between the lock member and the wear insert, and the undercut extends an angle that is less than 360 degrees about the axis of rotation.

5. The ripper assembly of claim 4 wherein the wear insert includes a front surface, a rear surface, a top surface, a bottom surface, a first side surface, a second side surface, a first retention boss extending from the rear surface along a direction perpendicular to the longitudinal axis, a second retention boss extending from the rear surface along a direction perpendicular to the longitudinal axis, and a locking boss extending from the rear surface along a direction perpendicular to the longitudinal axis and that is disposed between the first retention boss and the second retention boss along the longitudinal axis;

wherein the locking boss defines a perimeter and includes a locking ridge that forms an undercut along a direction perpendicular to the longitudinal axis that extends less than the entire length of the perimeter.

6. The ripper assembly of claim 5 wherein the wear insert is disposed in the at least first ripper shank pocket, the first retention boss is seated in the first cylindrical hole, the second retention boss is disposed in the second cylindrical hole, and the locking boss is seated in the clearance pocket and the retention cavity of the lock member, and the locking ridge of the locking boss and the retaining ledge of the lock member extend an angle that is 180 degrees or less about the axis of rotation of the lock member.

7. The ripper assembly of claim 6 wherein the wear insert includes a first blend surface connecting the top surface to the front surface, a second blend surface connecting the bottom surface to the front surface, and is configured such that the wear insert defines a rotational axis about which the wear insert may be rotated so that the initial position of the first retention boss becomes the new position of the second retention boss, and the initial position of the second retention boss becomes the new position of the first retention boss.

8. The ripper assembly of claim 1 wherein the retention boss aperture includes a first cylindrical hole disposed on the rear wall extending along a direction perpendicular to the longitudinal axis and the retention mechanism pocket is disposed adjacent the first cylindrical hole on the rear wall, the rear wall also defining a notch in communication with the retention mechanism pocket, the notch defining an undercut along a direction perpendicular to the longitudinal axis.

9. The ripper assembly of claim 8 wherein the rear wall defines an inner surface of the at least first ripper shank pocket, an outer surface, a second cylindrical hole disposed adjacent the retention mechanism pocket on the inner surface and the first cylindrical hole is disposed axially above the retention mechanism pocket on the inner surface, and the second cylindrical hole is disposed axially below the retention mechanism pocket, and the rear wall also defines a clearance pocket that is in communication with the retention mechanism pocket that extends from inner surface of the at least first ripper shank pocket while the retention mechanism pocket extends from the outer surface of the rear wall.

10. The ripper assembly of claim 9 further comprising a retention mechanism that is configured to fit within the retention mechanism pocket, the retention mechanism including a lock member defining an axis of rotation, an outer cylindrical surface, an inner radial direction, an outer radial direction, a retention cavity and including a retaining ledge overhanging the retention cavity along the inner radial direction, forming an undercut along the axis of rotation, the lock member further defining a female detent portion on the retaining ledge extending along a direction parallel with the axis of rotation, the lock member also including a lock tab extending in the outer radial direction from the outer cylindrical surface, and a retaining bushing including an annular body defining a cylindrical axis, an outer radial direction, a first end disposed along the cylindrical axis, a second end disposed along the cylindrical axis, an inner annular surface, an outer annular surface, and including a locking ridge extending from the outer annular surface along the outer radial direction at the first end configured to engage the retaining ledge of the lock member after the lock member has been rotated to a locking configuration, the inner annular surface defining a keyway extending along a direction parallel with the cylindrical axis, a rim portion at the second end extending from the outer annular surface along the outer radial direction, and a male detent portion extending from the outer annular surface along a direction parallel with the cylindrical axis.

11. The ripper assembly of claim 10 wherein the retention mechanism is disposed in retaining mechanism pocket, the retaining bushing is disposed between the lock member and the rear wall, and the undercut extends an angle that is less than 360 degrees about the axis of rotation.

12. The ripper assembly of claim 11 further comprising a wear insert that is configured to fit within the at least first ripper shank pocket, the wear insert including a front surface, a rear surface, a top surface, a bottom surface, a first side surface, a second side surface, a first retention boss extending from the rear surface along a direction perpendicular to the longitudinal axis, a second retention boss extending from the rear surface along a direction perpendicular to the longitudinal axis, and a locking boss extending from the rear surface along a direction perpendicular to the longitudinal axis and that is disposed between the first retention boss and the second retention boss along the longitudinal axis, the locking boss including a free end and an attachment portion extending from the rear surface, a key portion configured to be inserted into the keyway of the retaining bushing, and an inwardly flaring portion extending from the free end, and an outwardly flaring portion extending from the inwardly flaring portion to the attachment portion, wherein the diameter of the inwardly flaring portion decreases from the free end toward the outwardly flaring portion and the diameter of the outwardly flaring portion increases from the inwardly flaring portion to the attachment portion along a direction perpendicular to the longitudinal axis.

13. The ripper assembly of claim 12 wherein the wear insert is disposed in the at least first ripper shank pocket, the first retention boss is seated in the first cylindrical hole, the second retention boss is seated in the second cylindrical hole, the locking boss is disposed in the clearance pocket and the retention cavity of the lock member, the retaining bushing is installed on the locking boss and the locking ridge of the retaining bushing and the retaining ledge of the lock member extend an angle that is 90 degrees or less about the axis of rotation of the lock member.

* * * * *